United States Patent [19]

Hansen et al.

[11] 4,444,341

[45] Apr. 24, 1984

[54] TRANSPORTATION DEVICE FOR CONTINUOUSLY SUPPLYING MOLTEN METAL TO A CONTINUOUS CASTING PLANT

[75] Inventors: Herbert Hansen, Düsseldorf; Rudolf Hoffmann, Krefeld, both of Fed. Rep. of Germany

[73] Assignee: SMS Schloemann-Siemag A.G., Duesseldorf, Fed. Rep. of Germany

[21] Appl. No.: 259,810

[22] Filed: May 4, 1981

[30] Foreign Application Priority Data

May 8, 1980 [DE] Fed. Rep. of Germany ..... 3017548

[51] Int. Cl.³ ..... B22D 41/12

[52] U.S. Cl. ..... 222/591; 222/160; 164/438

[58] Field of Search ..... 164/335, 437, 438, 488; 222/590, 591, 606, 607, 160

[56] References Cited

U.S. PATENT DOCUMENTS 3,273,208 9/1966 Greenberger ..... 164/438 X 3,877,612 4/1975 Rokop et al. ..... 222/607 X 4,064,930 12/1977 Nakamura ..... 164/438 X

*Primary Examiner*—David A. Scherbel

*Attorney, Agent, or Firm*—Schwartz, Jeffery, Schwaab, Mack, Blumenthal & Koch

[57] ABSTRACT

A transport device for rapidly changing ladles for the continuous supply of metal melt to continuous casting plants by means of a reciprocating ladle bogie which is provided with means for receiving a sintle ladle. The bogie is moved between an operative position and an inoperative position, the bogie is positioned above a support from which an emptied casting ladle can be removed. In the operative position, the bogie is positioned above a casting station for supplying metal melt. The ladle bogie is open on the side nearest to the support and is rapidly driven back and forth between the inoperative and operative positions to provide a filled ladle from a crane and thereafter move an empty ladle to the support stand-by position for removal by the crane.

5 Claims, 3 Drawing Figures

TRANSPORTATION DEVICE FOR CONTINUOUSLY SUPPLYING MOLTEN METAL TO A CONTINUOUS CASTING PLANT

BACKGROUND OF THE INVENTION

1. Field of the Invention

The invention relates to a transportation device for continuously supplying metal melt to a continuous casting plant by means of a ladle bogie and to casting ladles which can be deposited therein.

2. Discussion of Related Art

Different systems are known for making metal melt available to perform sequence casting, i.e. uninterrupted continuous supply of the contents of several casting ladles successively into the molds of a single-strand or multi-strand plant. "Stahlstrang-Giessanlagen" (Continuous Steel Casting Plants) by Dr. Ing. Baumann, published by Verlag Stahl Eisen 1976, pp. 208 to 215 discloses the two most common systems. These are characterised in that in one case the ladles are taken up by two traversing ladle bogies and in the other case by a so-called ladle turning tower.

In both cases the liquid steel is first conveyed from the converters to the continuous casting plants to which end a shed crane is used. When using a ladle turning tower, which is constructed either with a rigid support arm adapted to pivot about a fixed turning column and two receptors or with two support arms, each being individually pivotable about a turning column and each having reception means for the ladle, casting is always performed from the ladle of the support arm which has been turned over the mold. The other support arm will then be in an inoperative position in which, after the contents of the pouring ladle have been cast, a filled ladle can be engaged and pivoted over the mold by exchange with the emptied ladle. Thereafter, the shed crane again releases the arm with the empty casting ladle.

In the method of operation with two casting ladle bogies, casting ladles are supplied, in terms of ladle changeover, as already described previously for a ladle turning tower, but with the difference that transportation is performed on a linear track instead of an arcuate pivoting track. Casting operation is fundamentally maintained by means of intermediate vessels, which act as buffer stations during the casting ladle changeover times.

Both casting ladle changeover systems have proved themselves fully in practice and ensure completely continuous operation of a continuous casting plant. The provision of two casting ladle bogies or of a ladle turning tower however presupposes a casting platform of sufficient size and therefore a correspondingly generously dimensioned casting shed.

SUMMARY OF THE PRESENT INVENTION

On the assumption that one casting ladle can be brought by means of a crane to a position above the mold of the continuous casting plant, it is the object of the present invention to enable a continuous casting operation to be performed even if the space available in the casting shed does not permit the use of conventional standby systems, such as, for example, a ladle turning tower or a double ladle bogie In other words, completely continuous casting should be possible even in continuous casting plants which are of the most compact possible construction and occupy only a minimum amount of space.

According to the invention the problem is solved by the provision of only one ladle bogie adapted for receiving only one casting ladle, which bogie can traverse from the casting position into an inoperative position in which the emptied casting ladle can be held by support means which support the bottom of the casting ladle while altering the vertical position thereof in relation to the ladle bogie so that the latter, which is open on the side nearest to the support means, can traverse back into the casting position when it is empty. In this solution to the problem the distance to be traversed by the single ladle bogie need amount to only slightly more than the diameter of the casting ladle thus ensuring extremely small space requirements for the transportation means according to the invention. The only condition governing rapid changing of casting ladles is that when an emptied ladle is driven away, a filled casting ladle must be suspended from a crane above the casting position so that this filled casting ladle can be rapidly deposited on the empty, returning ladle bogie. During the changeover period, casting continues in known manner from the intermediate container.

The change of vertical position of the emptied casting ladle in relation to the ladle bogie in the inoperative position can be obtained by arranging the support, adapted to hold the emptied casting ladle, to be constructed in a vertically movable configuration, for example by constructing it with a hydraulic lifting cylinder with a plurality of outrigger arms in star pattern configuration to increase its supporting surface area. By means of the said lifting cylinder it is possible for the emptied casting ladle to be simply lifted out of the ladle trunnion holders, which are open at the top and are disposed on the ladle bogie.

The support means can however also be immovable if the ladle bogie itself is provided with a vertically movable device for an engaged casting ladle. Such a vertically movable device is desirable for moving a casting ladle which is in the casting position; as regards the length of stroke of such a device for depositing an emptied casting ladle on the support it is merely necessary within the scope of the invention to ensure that, after depositing of an emptied casting ladle on the support, the receptors for the casting ladle trunnions can be sufficiently lowered to ensure that the ladle bogie can return empty into the casting position.

In another possibility of transferring an emptied casting ladle on to the support in the inoperative position while changing the vertical position of the casting ladle, the half open receptors on the ladle bogie for the trunnions of the casting ladle can be pivoted through approximately 90° about a pivoting axis which extends beneath the center axis of the trunnions. Since such a pivoting motion causes the half open receptors to assume a pivoted position in which said receptors are open to the side, it is possible for the ladle bogie to return immediately into the casting position after the emptied casting ladle has been transferred to the immovable support. The required lowering motion for transferring the casting ladle to the support is performed over the quadrant arc with the radius of the distance between the pivoting axis and the centre axis of the casting ladle trunnions. In this solution to the problems it is of course important to ensure that the perpendicular or almost perpendicular position of the half open receptors is fixed when a freshly filled casting ladle is deposited and held.

The operation of the transportation means described so far can also be reversed by depositing a filled casting ladle on the support, followed by the shed crane thereafter removing the emptied casting ladle from the casting position and the unoccupied ladle bogie receiving the filled casting ladle from the support; which also calls for a relative vertical motion between the casting ladle and the ladle bogie in order to engage the filled casting ladle with the ladle bogie

BRIEF DESCRIPTION OF THE DRAWINGS

The above and other objects of the present invention will become more readily apparent through the detailed description below, reference being had to the accompanying drawings in which like reference numerals represent like parts.

DETAILED DESCRIPTION OF THE PREFERRED EMBODIMENTS

Figure 1:
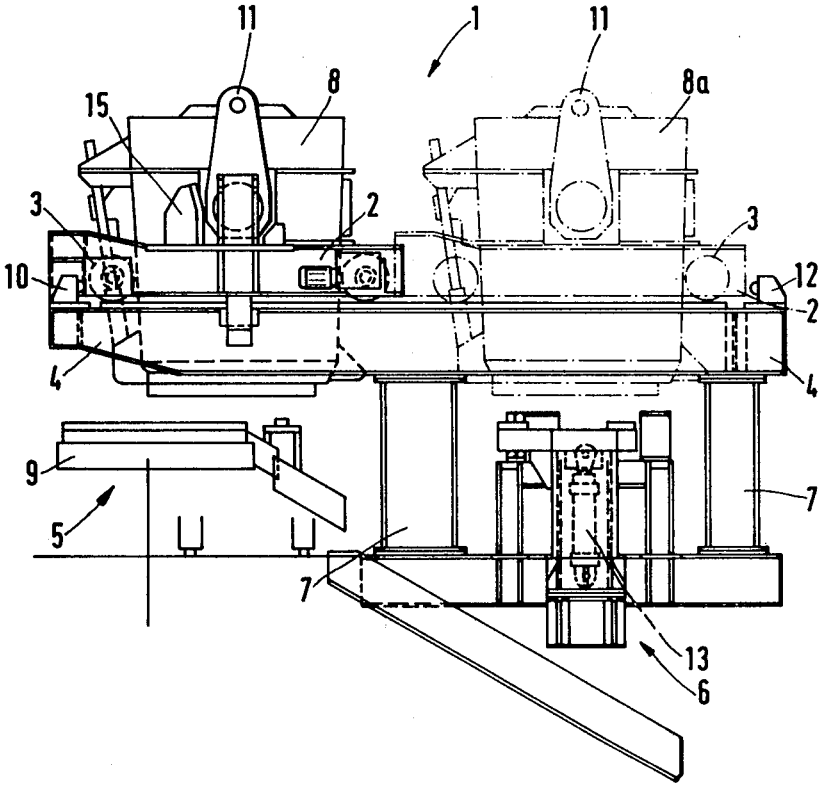
FIG. 1 is a side view of the casting ladle transportation means according to the invention

The view of FIG. 1 shows the arrangement of the casting ladle transportation means, referenced in their entirety with the numeral 1, on the casting platform of a single strand or multi strand continuous casting plant. The actual strand guidance frame and the mold are not shown.

The ladle bogie transportation means 1 comprise a traversable ladle bogie 2 which can move by means of wheels 3 on a track 4 between a casting position 5 and an inoperative position 6. The track 4 is situated at a specific height above the casting platform and bears on supports 7 which are disposed in a region of the casting platform not required for the actual casting operation. The track 4 is constructed to extend into the casting region so that a casting ladle 8, deposited on the ladle bogie 2, can deliver the molten steel via a discharge port into the intermediate vessel 9, which is only diagrammatically indicated.

As shown in FIG. 1, the ladle bogie 2 with casting ladle 8 is disposed on the track 4 above the intermediate vessel in the extreme travelling position which is defined by stop abutments 10. In this casting position the continuous casting plant is supplied with liquid steel during the entire duration of the sequence cast from the casting ladles, with the interposition of the intermediate vessel. The casting ladles release the desired quantity of steel through controlled plugs and pegs. When the contents of the ladle 8 in the process of casting are nearly exhausted, a shed crane, not shown, transports a freshly filled ladle and retains this in a standby position above the casting position 5 by means of suspension loops 11 of the crane attachments.

After the contents of the casting ladle 8 have been poured, the supply of the plant with liquid steel is maintained for a short period of time by the contents of the intermediate vessel 9. This is followed by a rapid exchange of the emptied ladle 8 for the fresh casting ladle suspended by the crane. Since the supplying operation is performed with only one ladle bogie 2, the said bogie travels for a short distance into the inoperative position 6 disposed immediately adjacent to or behind the casting position, where the track 4 is defined by a further stop abutment 12. As indicated by dash dot lines, the ladle bogie 4 with the empty casting ladle **8*a* is positioned centrally above a lifting cylinder 13** which is disposed beneath the track.

Figure 2:
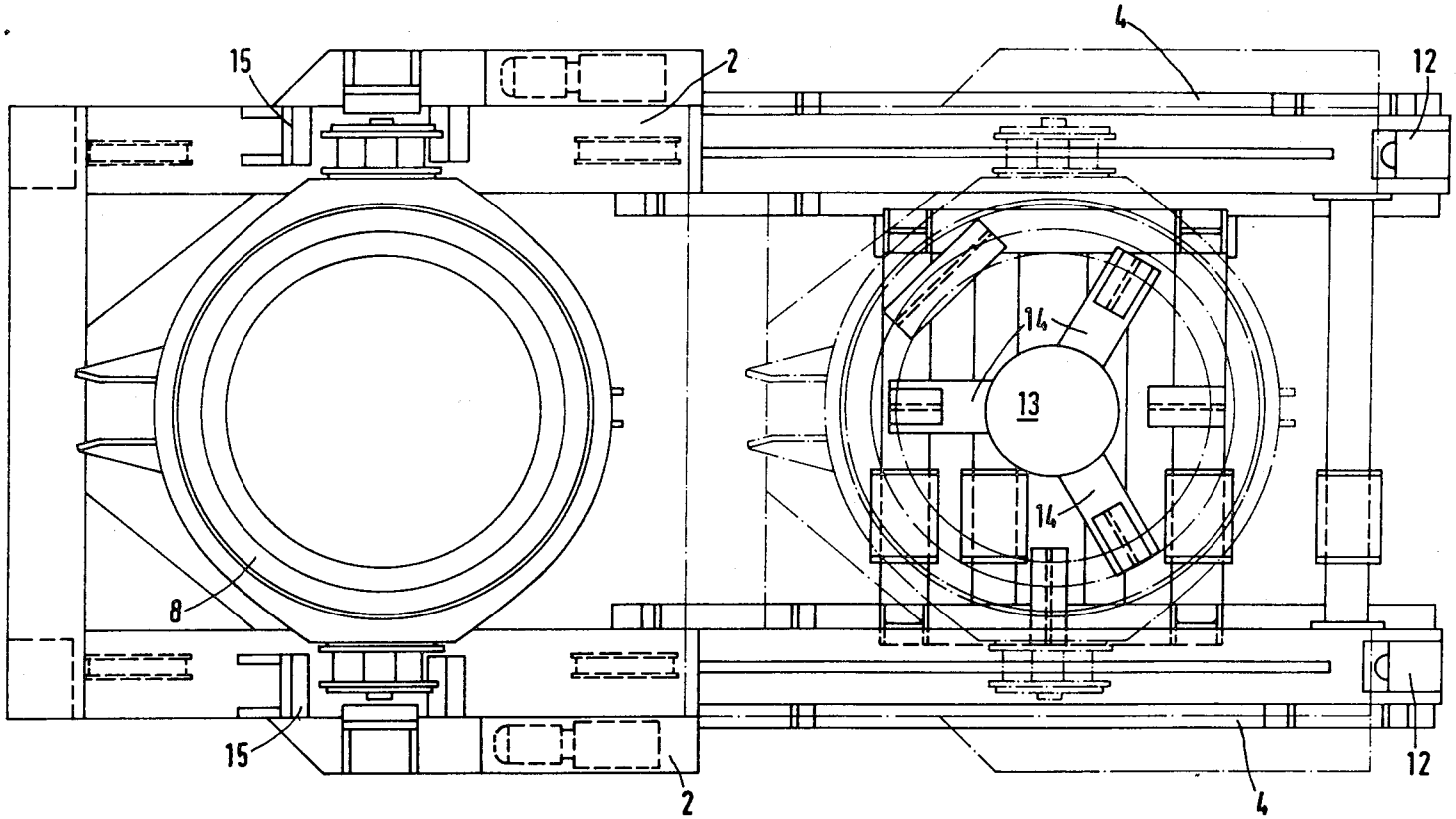
FIG. 2 is a plan view of FIG. 1.

When the lifting cylinder 13 is actuated, the piston thereof is extended and by means of a plurality of outrigger arms 14 (FIG. 2), which act on the bottom of the casting ladle, **8*a* lifts the latter from the receptors 15, which are open at the top, of the ladle bogie 4. The ladle bogie is therefore once again free and travels into the casting position so that the filled casting ladle, held in readiness by the crane and suspended by its slings 11 can now be deposited into the receptor means 15** of the ladle bogie.

Thereafter the shed crane removes the empty casting ladle **8*a*, raised by the lifting cylinder 13**, and transports it away.

The lifting cylinder 13, which should be operated in co-operation with an emptied ladle, with the advantage that the said cylinder need be designed only for the empty weight of a casting ladle, then travels into its unloaded starting position illustrated in FIG. 1, until it is next in the standby position.

Figure 3:
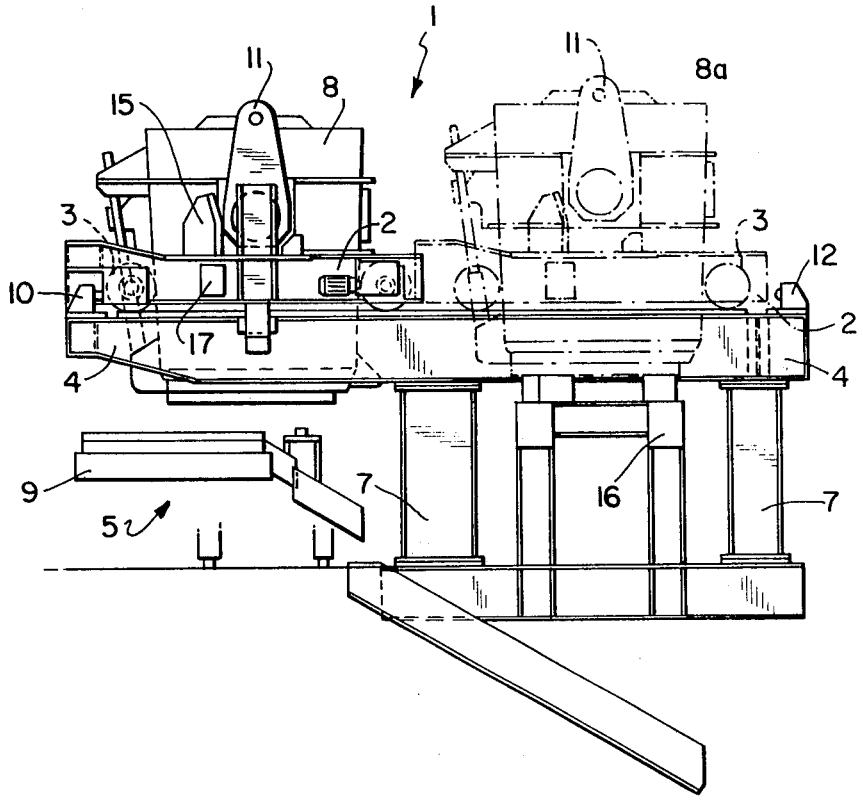
FIG. 3 is a side view of an alternate casting ladle transportation means according to the invention.

Alternatively, as shown in FIG. 3, the bogie 2 can be provided with a vertically movable lifting device 17 for engaging receptor means 15 for the casting ladle 8. The standby position is provided with an immovable support stand 16 upon which an empty ladle can rest. The stroke of the lifting device 17 should be large enough to ensure that, after depositing an emptied casting ladle on the support strand 16, the receptor means 15 for the casting ladle can be sufficiently lowered to ensure that the ladle bogie 2 can return empty to the casting position as shown in phantom in FIG. 3.

What is claimed is:

1. A device for providing a continuous supply of molten metal to a continuous casting plant, comprising: a transportation device for exchanging filled and empty ladles of molten metal, and a lifting means for carrying said filled and empty ladles to and away from said transportation device, said transportation device comprising:

a track;

a single casting ladle bogie generally of U-shaped configuration;

means for supporting said bogie on said track for movement between an operative position over an intermediate vessel, and an inoperative stand-by position for a ladle;

means on said bogie for removably holding a ladle; and raising and support means for lifting a ladle from said bogie and supporting said ladle in said stand-by position free of said bogie;

wherein said bogie is disposed on said track such that the open portion of said U faces said stand-by position whereby said bogie can be moved into and out of said stand-by position while a ladle is supported in said stand-by position.

2. The device as set forth in claim 1 wherein said raising and support means comprises a hydraulic lifting cylinder.

3. The device as set forth in claim 1 wherein said raising and support means comprises a stand having a vertically movable upper support surface.

4. The device as set forth in claim 1 wherein said raising and support means includes a star shaped support surface positioned to engage the bottom of a ladle in said stand-by position.

5. A device for providing a continuous supply of molten metal to a continuous casting plant, comprising: a transportation device for exchanging filled and empty ladles of molten metal, and a lifting means for carrying said filled and empty ladles to and away from said transportation device, said transportation device comprising:

a track;

a single casting ladle bogie generally of U-shaped configuration;

means for supporting said bogie on said track for movement between an operative position over an intermediate vessel, and an inoperative standby position for a ladle;

means for supporting said ladle in said standby position; and means on said bogie for lifting said ladle and lowering said ladle onto said support means;

wherein said bogie is disposed on said track such that the open portion of said U faces said standby position whereby said bogie can be moved into and out of said standby position while a ladle is supported in said standby position.

* * * * *